US010174452B2

(12) United States Patent
Choi

(10) Patent No.: US 10,174,452 B2
(45) Date of Patent: Jan. 8, 2019

(54) CLOTHES TREATING APPARATUS

(71) Applicant: LG ELECTRONICS INC., Seoul (KR)

(72) Inventor: Hongki Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/610,439

(22) Filed: May 31, 2017

(65) Prior Publication Data

US 2017/0350067 A1 Dec. 7, 2017

(30) Foreign Application Priority Data

Jun. 3, 2016 (KR) ..... 10-2016-0069744

(51) Int. Cl.

*D06F 73/02* (2006.01)
*D06F 58/12* (2006.01)
*D06F 58/20* (2006.01)
*D06F 58/28* (2006.01)

(52) U.S. Cl.

CPC ..... *D06F 73/02* (2013.01); *D06F 58/12* (2013.01); *D06F 58/206* (2013.01); *D06F 58/28* (2013.01); *D06F 2058/287* (2013.01); *D06F 2058/2854* (2013.01); *D06F 2058/2861* (2013.01); *D06F 2058/2864* (2013.01); *D06F 2058/2896* (2013.01)

(58) Field of Classification Search

CPC ..... D06F 73/02; D06F 58/12; D06F 58/206; D06F 58/28; D06F 2058/2854; D06F 2058/2861; D06F 2058/2864; D06F 2058/287; D06F 2058/2896

USPC ..... 34/546, 595–610

See application file for complete search history.

(56) References Cited

U.S. PATENT DOCUMENTS 6,845,290 B1 * 1/2005 Wunderlin ..... D06F 58/28 34/491
7,096,601 B2 * 8/2006 Lyu ..... D06F 29/00 34/595
7,137,211 B2 * 11/2006 Johnson ..... D06F 58/10 34/381
8,245,415 B2 * 8/2012 Bellinger ..... D06F 58/28 34/389

(Continued)

FOREIGN PATENT DOCUMENTS

CA 2345631 A1 * 11/2001 ..... D06F 58/28
CA 2345631 C * 12/2007 ..... D06F 58/28

(Continued)

*Primary Examiner* — Stephen M Gravini
(74) *Attorney, Agent, or Firm* — Dentons US LLP

(57) ABSTRACT

The present invention relates to a clothes treating apparatus, including a communication unit to transmit or receive information related to a usage history of the clothes treating apparatus, a memory to store the information related to the usage history, an air supply device to heat air supplied into an accommodation space of the clothes treating apparatus, and a controller to extract a use time zone of the clothes treating apparatus based on the information related to the usage history, drive the air supply device in a preset pattern within the extracted use time zone, and stop an operation of the clothes treating apparatus at a time zone except for the extracted use time zone.

11 Claims, 8 Drawing Sheets

(56) References Cited

U.S. PATENT DOCUMENTS

| | | | | |
|---|---|---|---|---|
| 8,601,717 | B2 * | 12/2013 | Beers | D06F 58/206 137/597 |
| 8,800,164 | B2 * | 8/2014 | Kim | D06F 25/00 137/597 |
| 8,919,009 | B2 * | 12/2014 | Colombo | D06F 58/28 34/413 |
| 9,133,575 | B2 * | 9/2015 | Hong | D06F 25/00 |
| 9,359,710 | B2 * | 6/2016 | Lee | D06F 58/10 |
| 9,605,375 | B2 * | 3/2017 | Frank | D06F 58/28 |
| 9,605,897 | B2 * | 3/2017 | Hyde | F26B 3/00 |
| 2004/0200093 | A1 | 10/2004 | Wunderlin et al. | |
| 2008/0155757 | A1 | 7/2008 | Kim et al. | |
| 2017/0350067 | A1 * | 12/2017 | Choi | D06F 58/12 |

FOREIGN PATENT DOCUMENTS

| | | | | |
|---|---|---|---|---|
| EP | 3252226 | A1 * | 12/2017 | D06F 58/12 |
| JP | 2008167889 | A | 7/2008 | |
| JP | 2014226418 | A | 12/2014 | |

* cited by examiner

CLOTHES TREATING APPARATUS

CROSS-REFERENCE TO RELATED APPLICATION

Pursuant to 35 U.S.C. § 119(a), this application claims the benefit of an earlier filing date of and the right of priority to Korean Application No. 10-2016-0069744, filed on Jun. 3, 2016, the contents of which are incorporated by reference herein in its entirety.

BACKGROUND OF THE INVENTION

1. Field of the Invention

The present invention relates to a clothes treating apparatus capable of removing wrinkles of clothes.

2. Background of the Invention

In recent years, various kinds of clothes treating apparatuses have been used together with washing machines for washing clothes. For example, there have been developed drum type driers for drying clothes that have been completely washed, cabinet type dryers for drying clothes while the clothes are hung, refreshers for refreshing clothes by supplying hot air to the clothes, and the like.

Among those clothes treating apparatuses, the dryer, the refresher and the like supply hot air heated mainly by a heater to clothes. Examples of the heater include a gas heater which heats air by burning gas, an electric heater which heats air by electric resistance, and the like. Recently, the electric heater which is easy to be installed and has a simple structure is widely used.

In recent years, clothes treating apparatuses which supply steam for removing wrinkles as well as supplying hot air to clothes stored therein have also been developed. Such developed clothes treating apparatuses mainly use a method of fixing clothes by pulling them to apply tension to the clothes and supplying steam to remove wrinkles of the clothes.

Meanwhile, when a user of a clothes treating apparatus activates a storage (keeping) function for storing clothes, the clothes treating apparatus keeps the heater on all the time, and thus unnecessary power consumption is increased.

That is, since the clothes treating apparatus cannot know when the user is to take out the clothes stored therein, the heater or a heat pump must be continuously driven. Therefore, in order to perform the storage function in the clothes treating apparatus, the power consumption is excessively increased and a lifespan of the heater or the heat pump is also reduced.

SUMMARY OF THE INVENTION

Therefore, an aspect of the present invention is to provide a clothes treating apparatus, capable of reducing power consumption while maintaining a clothes keeping (storage) function, by turning off a heater or a heat pump of the clothes treating apparatus at a time zone in which a user does not use the clothes treating apparatus even when any input is not applied by the user of the clothes treating apparatus.

In detail, an aspect of the present invention is to provide a clothes treating apparatus, capable of analyzing a user's usage pattern based on a usage history of the clothes treating apparatus.

Another aspect of the present invention is to provide a clothes treating apparatus, capable of efficiently consuming energy using big data related to the clothes treating apparatus and a user of the clothes treating apparatus.

To achieve these and other advantages and in accordance with the purpose of this specification, as embodied and broadly described herein, there is provided a clothes treating apparatus, including a communication unit to transmit or receive information related to a usage history of the clothes treating apparatus, a memory to store the information related to the usage history, an air supply device to heat air supplied into an accommodation space of the clothes treating apparatus, and a controller to extract a use time zone of the clothes treating apparatus based on the information related to the usage history, drive the air supply device in a preset pattern within the extracted use time zone, and stop an operation of the clothes treating apparatus at a time zone except for the extracted use time zone.

In accordance with one embodiment disclosed herein, the controller may divide a time into a use time zone in which probability that a user is to use the clothes treating apparatus is a first value or more, and a non-use time zone in which the probability is a second value or less, and the first value may be greater than the second value.

In accordance with one embodiment disclosed herein, the communication unit may perform wired/wireless communication with an external terminal, and the controller may control the communication unit to transmit a message to the external terminal to request for a command related to the operation of the clothes treating apparatus, when a time point does not correspond to the use time zone and the non-use time zone.

In accordance with one embodiment disclosed herein, the controller may reduce an operation cycle of the air supply device through comparison with the preset pattern, when a time point does not correspond to the use time zone and the non-use time zone.

In accordance with one embodiment disclosed herein, the communication unit may receive information related to electric charges, and the controller may extract the use time zone of the clothes treating apparatus based on the information related to the usage history and the information related to the electric charges.

In accordance with one embodiment disclosed herein, the information related to the usage history may include information related to at least one of a time point at which clothes are introduced into the accommodation space, a time point at which clothes are taken out of the accommodation space, a time point at which a door installed on the clothes treating apparatus is opened and closed, and a time point at which a user input related to an operation of the clothes treating apparatus is applied.

In accordance with one embodiment disclosed herein, the apparatus may further include a hanger provided within the accommodation space and having at least one clothes caught thereon, and a sensing unit to sense information related to the clothes caught on the hanger. The controller may detect at least one of a time point at which clothes are introduced into the accommodation space, a time point at which clothes are taken out of the accommodation space, and a time point at which a door installed on the clothes treating apparatus is opened and closed, based on information sensed by the sensing unit, when the door installed on the clothes treating apparatus is opened and then closed.

In accordance with one embodiment disclosed herein, the controller may update the information related to the usage history, on the basis of at least one of a time point at which clothes are introduced into the accommodation space, a time point at which clothes are taken out of the accommodation space, and a time point at which a door installed on the clothes treating apparatus is opened and closed.

In accordance with one embodiment disclosed herein, the hanger may include a motor to provide power for applying a predetermined motion to the clothes caught on the hanger. The controller may drive the motor at a preset time interval when the door is opened and then closed, detect information related to a weight of the clothes caught on the hanger, based on a power value consumed by the motor, while the motor is driven, and detect the time point at which the clothes are introduced into the accommodation space, based on the detected weight.

In accordance with one embodiment disclosed herein, the sensing unit may include a weight sensor to detect a weight of the clothes caught on the hanger, and the controller may detect the time point at which the clothes are introduced into the accommodation space, based on a sensing value of the weight sensor, when the door is opened and then closed.

In accordance with one embodiment disclosed herein, the communication unit may receive information related to a use time zone of another clothes treating apparatus from an external server, and the controller may extract the use time zone of the clothes treating apparatus, by using the information related to the usage history and the information related to the another clothes treating apparatus.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of exemplary embodiments disclosed herein, with reference to the accompanying drawings.

In describing the present invention, if a detailed explanation for a related known function or construction is considered to unnecessarily divert the gist of the present disclosure, such explanation has been omitted but would be understood by those skilled in the art.

The accompanying drawings are used to help easily understood the technical idea of the present invention and it should be understood that the idea of the present disclosure is not limited by the accompanying drawings. As such, the present disclosure should be construed to extend to any alterations, equivalents and substitutes in addition to those which are particularly set out in the accompanying drawings.

Figure 1A:
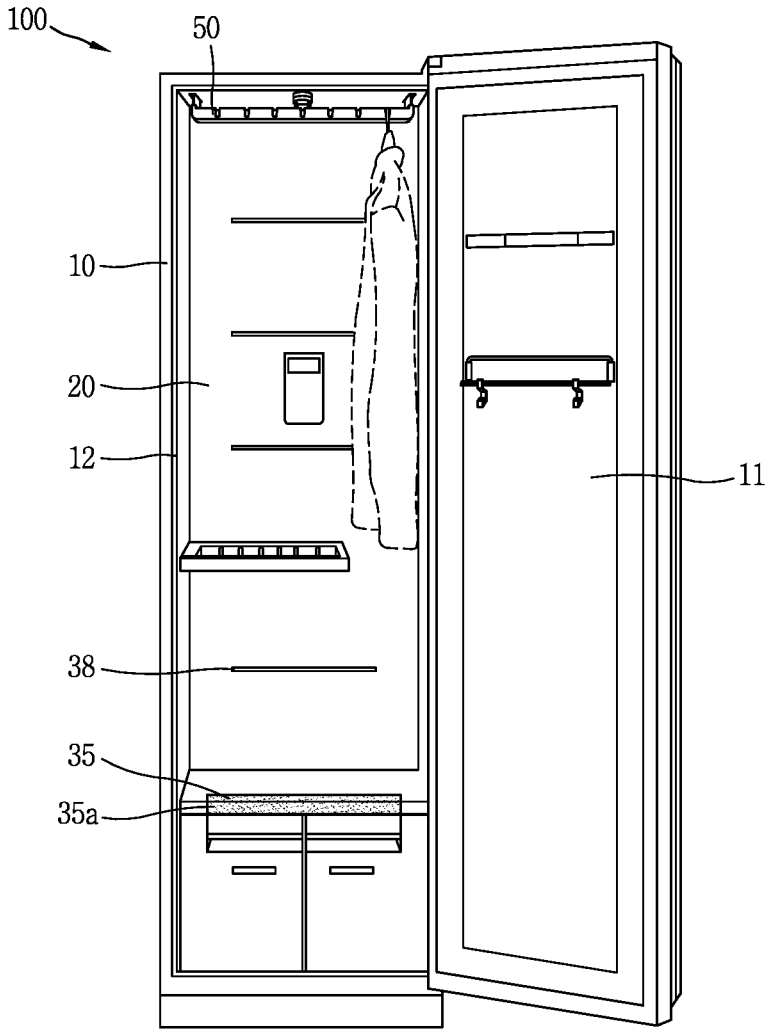
FIGS. 1A and 1B are conceptual views of a clothes treating apparatus in accordance with one embodiment of the present invention.
Figure 1B:
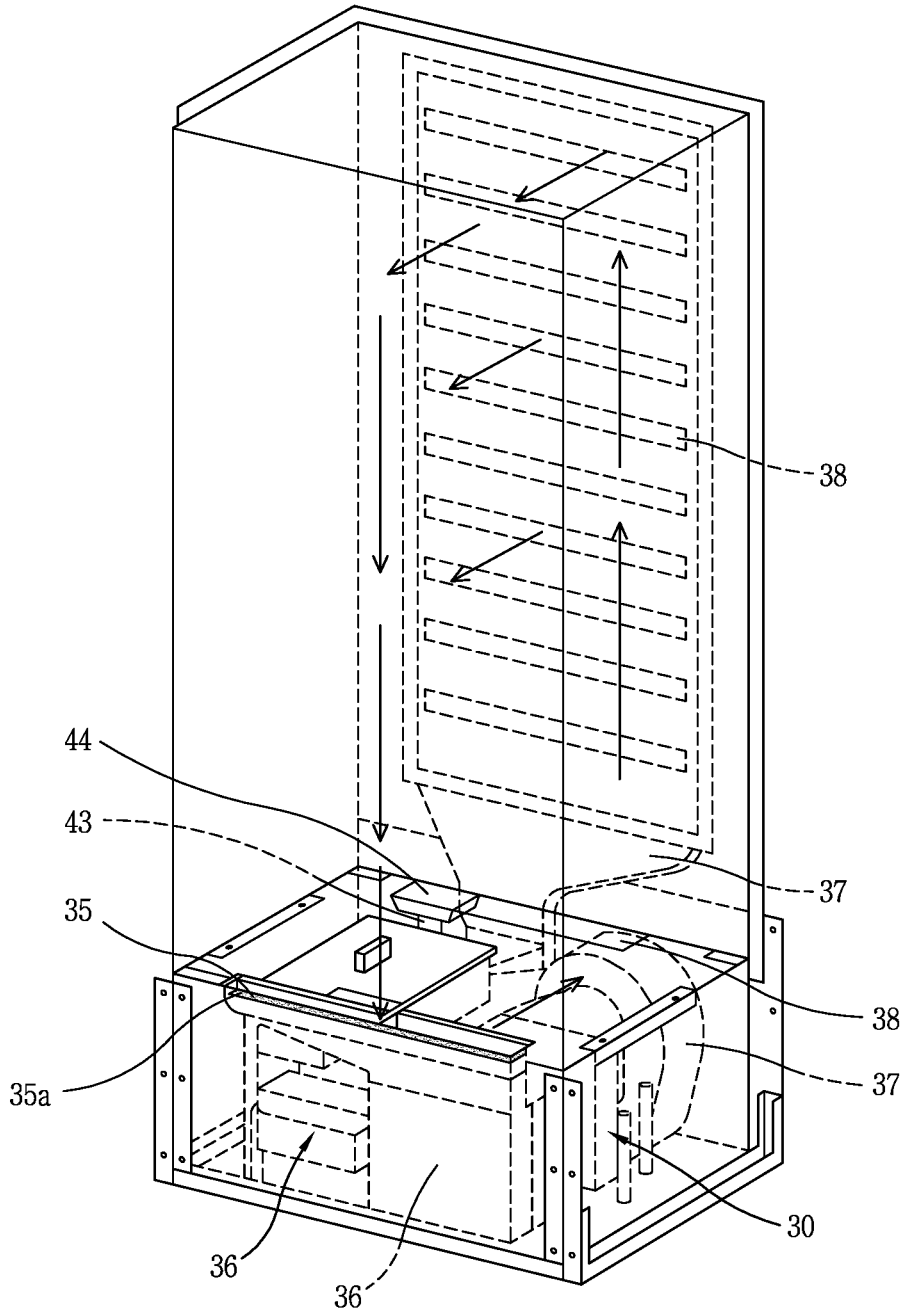
Figure 1C:
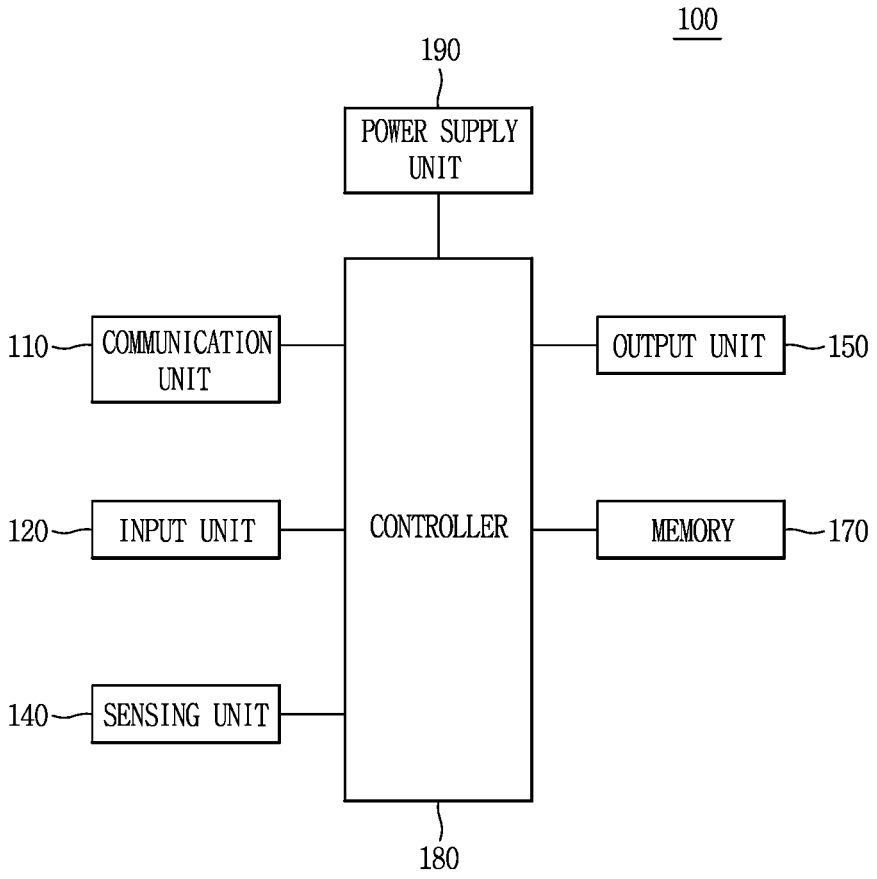
FIG. 1C is a block diagram of a clothes treating apparatus in accordance with one embodiment of the present invention.

FIG. 1 is a conceptual view of a clothes treating apparatus 100 according to one embodiment of the present invention.

First, the cabinet 10 forms an outer appearance of the clothes treating apparatus according to the present invention, and is provided with an accommodation space 20 formed therein for accommodating clothes (clothing) to be treated.

As illustrated in FIG. 1, the accommodation space 20 is actually formed by an inner cabinet 12, which is provided separately within the cabinet 10. The inner cabinet 12 is fixed to the cabinet 10 and thus remains stationary. The accommodation space 20 as well as the inner cabinet 20 is not moved. The accommodation space 20 and the inner cabinet 12 may be disposed at an upper portion of the cabinet 10 and a front portion of the accommodation space 20 is opened.

That is, the accommodation space 20 has an inlet formed in the front portion thereof, and thus a user can easily put the clothes into the accommodation space 20 through the inlet. The accommodation space 20 may selectively be opened or closed by a door 11 which is rotatably installed on the cabinet 10.

Various switches (not illustrated) for operating the clothes treating apparatus may be provided on an outer surface of the door 11 or the cabinet 10.

Referring to FIG. 1B, an outfit chamber having a predetermined size is formed below the accommodation space 20, and an air supply device 30 is installed in the outfit chamber. The air supply device 30 basically removes moisture from air and provides dry air into the accommodation space 20 for drying clothes.

In addition, the air supply device 30 may heat the air to supply hot and dry air. Since hot air generally rises in an upward direction, it is advantageous that the air supply device 30 is installed at a lower portion of the cabinet 10, namely, below the accommodation space 20 in view of supplying hot and dry air. The air supply device 30 is preferably separated from the accommodation space 20 by a separate barrier wall. A top wall of the outfit chamber or a bottom wall of the inner cabinet 12 may be actually the barrier wall. The barrier wall may prevent the clothes from being damaged by the high-temperature air supply device 30 and prevent condensed water generated in the air supply device 30 from being soaked in the clothes.

The air supply device 30 may include a heater or a thermoelement for producing hot air and a dehumidifier provided separately from such heater. However, it is preferable to use a heat pump which is capable of simultaneously performing dehumidification and air heating.

Therefore, the clothes treating apparatus uses a heat pump as the air supply device 30. The air supply device 30 is provided with an evaporator, a compressor, a condenser, and an expansion valve (not shown) through which refrigerant is circulated. In this case, while refrigerant is evaporated in the evaporator, the refrigerant absorbs latent heat of ambient air and cools the air. By cooling the air, moisture in the air can be condensed and thus removed. Further, when the refrigerant is condensed in the condenser after being compressed in the compressor, the refrigerant heats ambient air by releasing latent heat toward the ambient air. Accordingly, the evaporator and the condenser serve as a heat exchanger, and thus air introduced into the air supply device 30 becomes dry and hot while passing through the evaporator and the condenser.

Thus, the clothes treating apparatus using the heat pump can be dehumidified without using a separate dehumidifier. Therefore, air generated in the air supply device 30 can effectively dry the clothes within the accommodation space 20, such that the clothes can be refreshed into a suitable state to be worn.

As illustrated in FIG. 1B, the accommodation space 20 is provided with a suction port 35 through which air within the accommodation space 20 is introduced into the air supply device 30. The introduced air is heated and dehumidified in the air supply device 30, i.e., the evaporator and the condenser. In addition, the accommodation space 20 is provided with a discharge port 38 through which dry and hot air from the air supply device 30 is supplied into the accommodation space 20. Therefore, the clothes treating apparatus can have a circulation flow path of the dry air generated by the air supply device 30.

This specification will describe a refresher, which refreshes clothes and supplies hot air, as a clothes treating apparatus. However, the present invention is not limited to this and may alternatively be applied to other devices which may include a heat pump to be described later. Here, refreshing may refer to supplying air, heated air, water, mist, steam, etc. to clothes to remove wrinkles of the clothes, deodorize the clothes, sanitize the clothes, prevent static electricity, warm the clothes and the like. In addition, clothes disclosed in this specification include not only clothing and apparel, but also objects such as shoes, socks, gloves, hats, shawls, etc. which can be worn by a user, and objects such as dolls, towels, bedclothes, etc. which can be used by the user, namely, every object that can be washed.

The cabinet 10 is provided with various components to be described later and includes the accommodation space 20 in which clothes are accommodated. The accommodation space 20 selectively communicates with outside by the door 11. In addition, the accommodation space 20 is provided with various types of supports (or supporting rods) (not illustrated) for hanging clothes. The supports may be provided to keep the clothes stationary or fixed without movement. On the other hand, the supports may be configured, as described later, to apply a predetermined motion to the clothes when air, hot air, moisture, mist, steam, or the like is supplied.

That is, referring to FIG. 1A, the clothes are caught on a moving hanger 50 provided in the accommodation space 20. The moving hanger (50) is configured to apply a predetermined motion to the clothes. If the predetermined motion is applied while air, hot air, moisture, mist, steam, or the like is supplied to the clothes, the refreshing effect of the clothes is increased.

Referring to FIG. 10, the clothes treating apparatus 100 includes at least one of a communication unit 110, an input unit 120, a sensing unit 140, an output unit 150, a memory 170, a controller 180, and a power supply unit 190.

The communication unit 110 may include at least one component for performing wired/wireless communication between the clothes treating apparatus 100 and a wired/wireless communication system or between the clothes treating apparatus 100 and a network in which the clothes treating apparatus 100 is located. For example, the communication unit 110 may include a broadcast receiving module, a wireless Internet module, a short-range communication module, a location information module, and the like.

The wireless Internet module included in the communication unit 110 refers to a module for performing a wireless Internet access, and may be disposed internally or externally at the clothes treating apparatus 100. Here, examples of wireless Internet technologies may include a wireless LAN (WLAN), wireless fidelity (Wi-Fi), Wibro, WiMAX, high speed downlink packet access (HSDPA), and the like.

The short-range communication module included in the communication unit 110 refers to a module for performing short-range communication. Examples of short-range communication technologies may include Bluetooth, radio frequency identification (RFID), infrared data association (IrDA), ultra wideband (UWB), ZigBee, etc.

The location information module included in the communication unit 110 is a module for confirming or obtaining a location (position) of the clothes treating apparatus. One example is a global position system (GPS) module. The GPS module receives location information from a plurality of satellites. Here, the location information may include coordinate information indicated by latitude and longitude. For example, the GPS module may measure an accurate time and distance from three or more satellites, and accurately calculate a current location of the mobile terminal according to trigonometry based on the measured three different distances. A method of obtaining distance and time information from three satellites and correcting an error with one satellite may be used. In particular, the GPS module may acquire three-dimensional velocity information and accurate time as well as the location of latitude, longitude and altitude, from the location information received from the satellites.

The communication unit 110 may receive data from a user and transmit information processed by the controller 180 of the clothes treating apparatus 100 and information sensed by the sensing unit 140 to an external terminal (not illustrated).

The sensing unit 140 may sense internal or external temperature of a storage chamber of the clothes treating apparatus, opening of the door of the clothes treating apparatus, and the like.

More specifically, the sensing unit 140 may include a sensor for sensing temperature of at least one of an inlet of the evaporator and an outlet of the evaporator.

The sensing unit 140 may include at least one sensor attached to one surface of the interior of the clothes treating apparatus, and at least one sensor attached to one of outer wall surfaces of the clothes treating apparatus to sense temperature of external air. In addition, the sensing unit 140 may include a sensor for sensing whether the compressor is driven, and a value of a cooling capacity of the compressor. Information sensed by the sensing unit 140 may be transmitted to the controller 180.

The input unit 120 is to receive a user input for the operation of the clothes treating apparatus 100 or confirming the state of the clothes treating apparatus 100 so as to output a signal corresponding to the user input. The input unit 120 may be implemented in a form of a button or a touch pad.

More specifically, the input unit 120 may be implemented in a form of a touch screen on a display of the output unit 150 of the clothes treating apparatus. Also, the input unit 120 may further include a camera module for capturing an image of clothes to be stored in the clothes treating apparatus, or an image of a bar code or a QR code attached to the clothes. In addition, the input unit 120 may further include a microphone for inputting audio such as a user's voice.

The memory 170 may store information related to the clothes treating apparatus 100, for example, a program for driving the clothes treating apparatus 100, information set for driving the clothes treating apparatus, a clothes treating apparatus application, status information related to the clothing treating apparatus, information related to clothes stored in the clothes treating apparatus, user information, multimedia contents, and the like, and may also include icons or graphic data for visually expressing such information.

The memory 170 may store at least one of location information related to an installed place of the clothes treating apparatus 100, information related to at least one terminal to collect a location, and connection information related to a server (not illustrated).

The output unit 150 is to display information related to the clothes treating apparatus in a visual or audible manner, and may include a flat display and a speaker. Specifically, the display may be configured as a touch panel receiving a user's touch input.

The display of the output unit 150 displays a User Interface (UI) or a Graphic User Interface (GUI) associated with driving of the clothes treating apparatus. More specifically, the display may include at least one of a liquid crystal display, a thin film transistor liquid crystal display, an organic light emitting diode, a flexible display, and a 3D display. Two or more displays may be provided depending on the implementation of the clothes treating apparatus 100. For example, a first display and a second display may be provided at different positions on one surface of the door of the clothes treating apparatus 100.

When the display and a sensor (hereinafter, referred to as 'touch sensor') for sensing a touch operation are interlayered (hereinafter, referred to as 'touch screen'), the display may also be used as an input device as well as an output device. The touch sensor may be configured in a form of, for example, a touch film, a touch sheet, a touch pad, or the like.

The power supply unit 190 receives external and internal power under the control of the controller 180 and supplies power necessary for operations of respective components.

The operation of the controller 180 or an operation of an application executed by the operation of the controller 180 is based on an intermediary operation of an operating system, and description of the intermediary operation will be omitted.

In addition to the operations associated with the application program, the controller 180 typically controls the overall operation of the clothes treating apparatus 100. The controller 180 may provide or process information or functions assorted to a user by processing signals, data, information, and the like input or output through the components described above or by operating an application program stored in the memory 170.

Hereinafter, one embodiment of a system including a clothes treating apparatus will be described with reference to FIG. 2.

Figure 2:
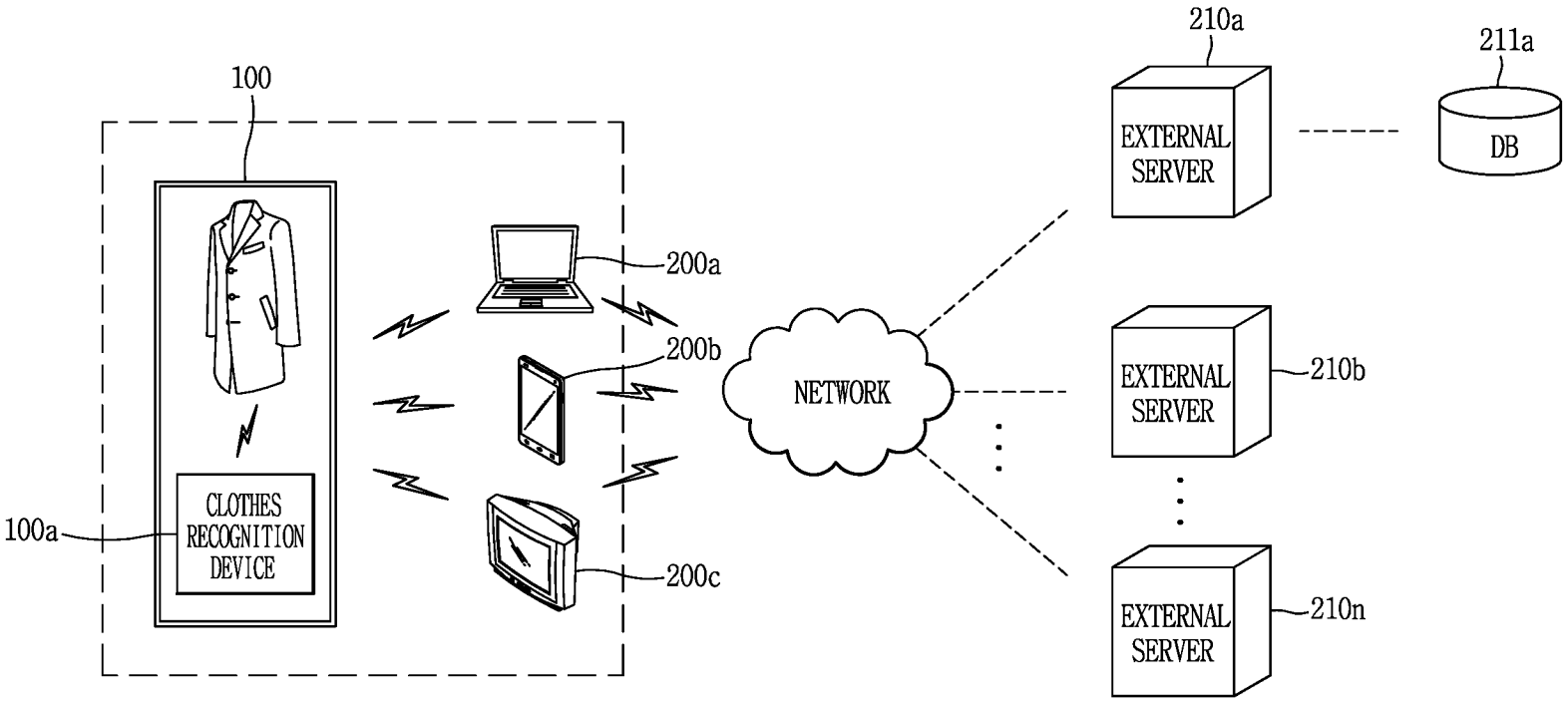
FIG. 2 is a conceptual view illustrating a system having a clothes treating apparatus.

As illustrated in FIG. 2, the system including the clothes treating apparatus 100 includes clothes accommodated in the clothes treating apparatus 100 installed indoors, a clothes recognition device 100*a*, a plurality of first to third client devices 200*a*, 200*b* and 200*c* located indoors, a network, a management server 210*a*, a database 211*a*, and a plurality of clothes information servers 210*b* to 210*n*.

The clothes stored in the clothes treating apparatus 100 may be directly worn on a user's body, namely, correspond to all of tops (blouses, shirts, etc.), bottoms (pants), hats, shoes, ties, wigs, accessories (including jewelry such as necklaces, rings, bracelets, etc.). An RFID tag (not illustrated) may be attached to each clothing.

The RFID tag stores various kinds of information related to the clothes (that is, a manufacturer, a manufactured year, a style, a size, a color, etc. for a shirt) in a memory. The RFID tag may be granted a unique number so as to provide the information related to the clothes to the clothes recognition device 100*a* through RF communication.

The clothes recognition device 100*a* receives information related to clothes stored in the clothes treating apparatus 100 from the RFID tag, stores the information, and provides the clothes information to the client devices 200*a*, 200*b* and 200*c*.

The first to third client devices 200*a*, 200*b* and 200*c* may provide the clothes information provided from the clothes recognition device 100*a* to the management server 210*a* via the network and receive clothes management information provided from the management server 210*a* so that the user can inquire the information.

Similar to a desktop computer terminal, a notebook computer terminal, a tablet PC, a mobile communication terminal, a smart phone and the like, each of the client devices 200*a*, 200*b* and 200*c* may perform remote communication via the network in a wired or wireless manner, and any computing device may be applicable as the client device if it can perform short-range wireless communication, such as Wi-Fi communication, with the clothes recognition device 100*a*.

Here, the clothes recognition device 100*a* may be included in the clothes treating apparatus 100 and performs data transmission and reception with the communication unit 110 of the clothes treating apparatus 100.

In addition, in FIG. 2, the network corresponds to a cloud network in which a wired/wireless signal network such as a mobile communication network, a public telephone network, etc., and a digital network such as an Internet network, a financial communication network, etc. are integrated.

Hereinafter, one embodiment related to a moving hanger will be described with reference to FIGS. 3A and 3B.

Figure 3A:
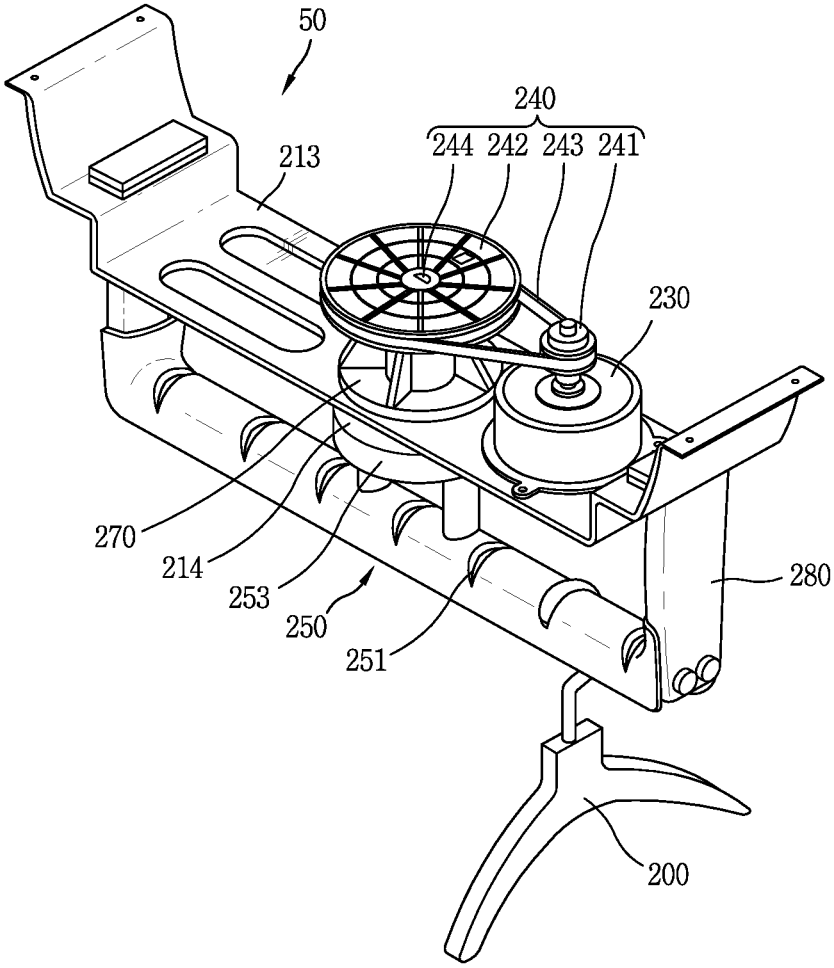
FIGS. 3A and 3B are conceptual views illustrating one embodiment related to a moving hanger of FIG. 1A.

Referring to FIG. 3A, a moving hanger 50 includes a hanger bar 250 for supporting clothes caught on a coat hanger 200, and supporting parts 280 for supporting both ends of the hanger bar 250. The hanger bar 250 is provided with a plurality of hanger grooves (251) each for fixing a position of the coat hanger 200 when the coat hanger 200 is mounted. The supporting parts 280 are connected to a moving hanger frame 213 and the moving hanger frame 213 is provided on a ceiling within the cabinet 10 so as to be invisible from outside. Supporting ribs 254 are provided on both ends of the hanger bar 250 so as to surround end portions of the supporting parts 280, respectively.

Therefore, the clothes treating apparatus according to the present invention can expect a superior effect in drying efficiency of clothes as well as a refreshing effect, compared to the related art clothes treating apparatus, because the clothes stored in the clothes treating apparatus are caught on the coat hangers.

On the other hand, the moving hanger 50 includes a motor 230, a power conversion unit (not illustrated) for converting a rotational motion provided by the motor 230 into a horizontal linear motion of the hanger bar 250, and a power transmission unit 240 for transmitting power supplied by the motor 230 to the power conversion unit.

The power transmission unit 240 includes a driving pulley 241 provided on the motor 230, a driven pulley 242 connected to the driving pulley 241 by a belt 243, and a rotating shaft 244 coupled to a center of the driven pulley 244. The rotating shaft 244 is rotatably provided within a bearing housing 270 provided on the moving hanger frame 213.

Preferably, the hanger bar 250 further includes a slot (not illustrated) orthogonal to a longitudinal direction thereof. Specifically, the hanger bar 250 is provided with a slot housing 253 at an upper portion thereof, and the slot at an approximately central portion of the slot housing 253. The power conversion unit includes a slot insertion portion inserted into the slot, an axial coupling portion coupled to the rotating shaft 244, and a rotary arm connecting the slot insertion portion and the axial coupling portion. The power conversion unit is enclosed by a cover 214 so as to be invisible from the outside, and the cover 214 is provided between the moving hanger frame 213 and the slot housing 253.

With the configuration, when the motor 230 rotates, the driven pulley 242 is rotated. Accordingly, the rotating shaft 244 coupled to the driven pulley 242 is also rotated, and the slot insertion portion performs a circular motion with a predetermined diameter.

The slot provided at the hanger bar 250 is formed to be orthogonal to the longitudinal direction of the hanger bar 250 and also has a length longer than a diameter of a rotation locus of the slot insertion portion. Therefore, the slot may perform a linear motion in a horizontal direction even if the slot insertion portion performs the circular motion. Thus, the hanger bar 250 coupled to the slot is subject to a horizontal linear motion.

Figure 3B:
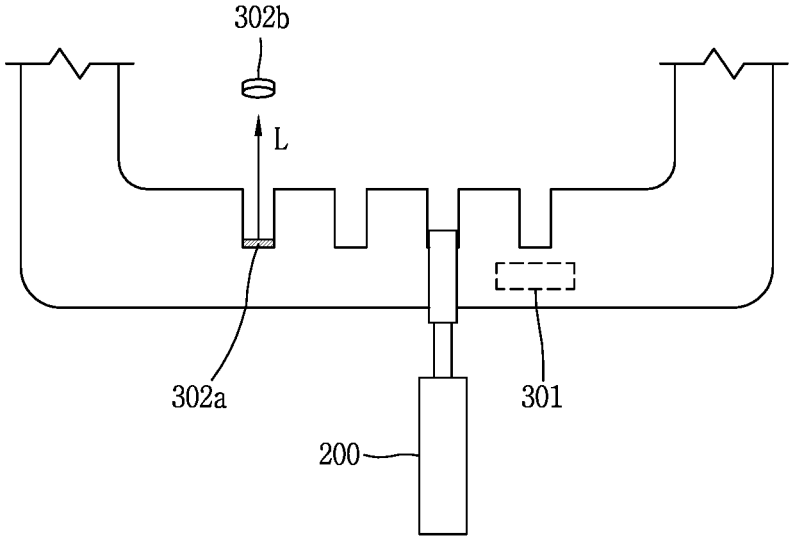

Referring to FIG. 3B, a plurality of sensors are provided in portions of the moving hanger 50 to determine whether or not new clothes are caught on the moving hanger 50.

As illustrated in FIG. 3B, the moving hanger 50 may include a plurality of sensors for determining whether or not new clothes are caught on the moving hanger 50.

Specifically, the moving hanger 50 may be provided with a weight sensor 301 for determining whether or not new clothes are caught on the moving hanger 50. In one embodiment, the moving hanger 50 may include a plurality of weight sensors 301 corresponding to the plurality of hanger grooves 251, respectively.

As illustrated in FIG. 3B, the weight sensor 301 may be installed inside the hanger bar 250. In particular, the weight sensor 301 may be installed at a position, on which where the hanger groove 251 is formed, within the hanger bar 250. Thus, when the coat hanger 200 with clothes caught is hung on the hanger groove 251, the weight sensor 301 may sense weights of the coat hanger 200 and the clothes. The controller 180 may detect that the new clothes are caught on the moving hanger 50 based on the sensing value sensed by the weight sensor 301.

For example, when the sensing value sensed by the weight sensor 301 corresponds to a weight of the coat hanger 200, the controller 180 may determine that only the coat hanger 200 is caught on the moving hanger 50.

In another example, when the sensing value sensed by the weight sensor 301 is greater than the weight of the coat hanger 200 by a predetermined weight value or more, the controller 180 may determine that the coat hanger 200 with clothes caught is hung on the moving hanger 50.

In another example, when the sensed value sensed by the weight sensor 301 changes by a predetermined weight value or more within a preset time interval, the controller 180 may determine that the coat hanger 200 with newly-stored clothes caught thereon is hung on the moving hanger 50.

In another example, when the sensed value sensed by the weight sensor 301 increases by a predetermined weight value or more within a preset time interval, the controller 180 may determine that the coat hanger 200 with newly-stored clothes caught thereon is hung on the moving hanger 50.

In another example, when the sensed value sensed by the weight sensor 301 is reduced and a sensing value sensed after the reduction is more than a reference weight value, the controller 180 may determine that the coat hanger 200 with newly-stored clothes caught thereon is hung on the moving hanger 50.

Also, referring to FIG. 3B, an optical sensor 302 may be installed at a portion of the hanger bar 250. In particular, the optical sensor 302 may be installed on a bottom of the hanger groove 251 and may emit preset light toward the ceiling of the clothes treating apparatus 100. A light receiving portion corresponding to the optical sensor 302 may be installed in the ceiling of the clothes treating apparatus 100.

Thus, while the light receiving portion receives light emitted from the optical sensor 302, when the light is blocked for a predetermined time or more, the controller 180 may determine that new clothes are stored on the moving hanger 50.

In one embodiment, the moving hanger 50 may include a plurality of optical sensors 302 corresponding to the plurality of hanger grooves 251, respectively. Further, the light receiving portions corresponding to the plurality of optical sensors 302 may be provided in the ceiling of the clothes treating apparatus 100. In this case, if no light is received in any one of the light receiving portions for a predetermined time or more and a light reception state of another light receiving portion is not changed, the controller 180 may determine that new clothes are caught on the moving hanger 50. Here, the light reception state of the light receiving portion may be divided into a state of receiving light and a state of not receiving light.

On the other hand, the controller 180 may determine whether or not clothes are added into the clothes treating apparatus 100 by using a camera module installed inside the clothes treating apparatus 100.

In another embodiment, the controller 180 may drive the motor 230 of the moving hanger 50 when it is determined that the door of the clothes treating apparatus 100 is opened and then closed. The controller 180 may also detect a power value consumed by the motor 230 while the motor 230 is driven and calculate a weight of clothes caught on the moving hanger 50 based on the detected power value. Thus, when it is determined that the weight of the clothes caught on the moving hanger 50 has changed or increased as compared with the weight sensed before the door is opened and closed, the controller 180 may determine that new clothes to be stored in the clothes treating apparatus 100 are added.

Figure 4:
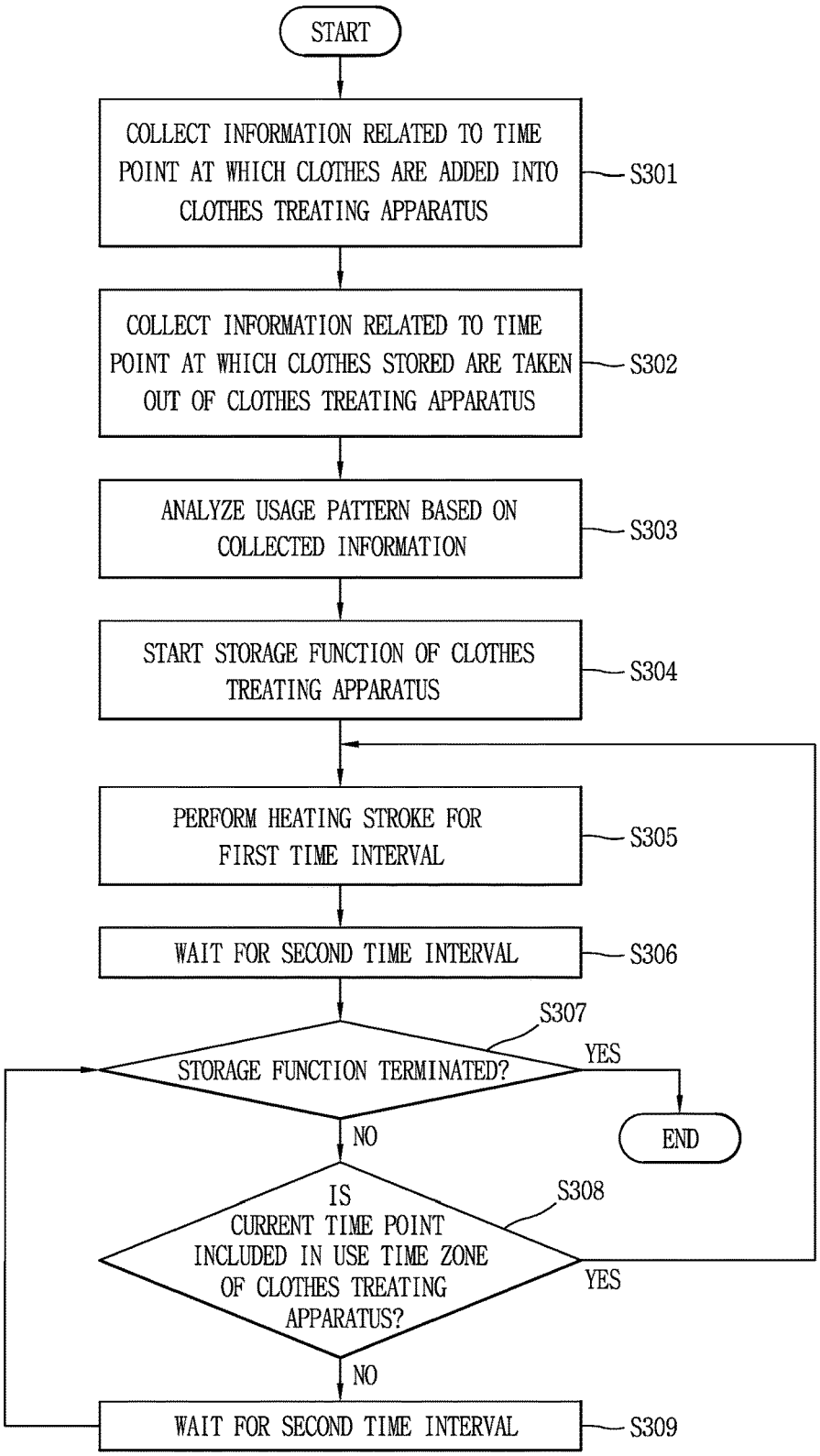
FIG. 4 is a flowchart illustrating a method for controlling a clothes treating apparatus in accordance with the present invention.

Hereinafter, a method for controlling a clothes treating apparatus according to the present invention will be described with reference to FIG. 4.

The clothes treating apparatus 100 may collect information related to a time point at which clothes are added (S301). In addition, the clothes treating apparatus 100 may collect information related to a time point when clothes stored are taken out (S302).

In detail, the controller 180 of the clothes treating apparatus 100 may determine whether or not clothes are added into the clothes treating apparatus 100 or whether or not clothes being stored in the clothes treating apparatus 100 are taken out, every time when the door of the clothes treating apparatus 100 is opened or closed. In addition, the controller 180 of the clothes treating apparatus 100 may collect information related to a time point at which it is determined that clothes are added or taken out.

In one embodiment, the controller 180 may determine whether or not clothes are added or taken out, by using a weight sensor installed in the coat hanger or the moving hanger of the clothes treating apparatus 100.

In detail, the controller 180 may detect a time point at which clothes are accommodated into the accommodation space, based on the sensing value of the weight sensor, when the door is opened and then closed.

In another embodiment, the controller 180 may use an optical sensor installed in the coat hanger or the moving hanger of the clothes treating apparatus 100 to determine whether or not clothes are added or taken out.

In another embodiment, when the door is opened and then closed, the controller 180 may drive the motor 230 included in the moving hanger for a preset time interval, and detect information related to a weight of the clothes caught on the moving hanger based on a power value consumed by the motor while the motor is driven. Thus, based on the detected weight, the controller 180 can detect a time point at which the clothes are put into the accommodation space of the clothes treating apparatus 100.

In another embodiment, the controller 180 may determine whether or not clothes are added or taken out, by using the camera module installed inside the clothes treating apparatus 100.

In another embodiment, the controller 180 may determine that a time point of turning on the clothes treating apparatus 100 is a time point that clothes are added. In addition, the controller 180 may determine that a time point at which a user input for terminating a specific operation mode of the clothes treating apparatus 100 is applied is a time point that clothes are taken out.

In another embodiment, the communication unit 110 of the clothes treating apparatus 100 may receive information related to a usage history of the clothes treating apparatus 100 from an external server, and the controller 180 may extract information related to a time point of adding or taking out clothes into or from the clothes treating apparatus from the usage history information.

For example, the information related to the usage history may include information related to at least one of a time point at which clothes are put into the accommodating space, a time point at which clothes are taken out of the accommodating space, a time point at which the door installed on the clothes treating apparatus is opened and closed, and a time point at which a user input related to an operation of the clothes treating apparatus is applied.

The controller 180 may analyze information related to a usage pattern of the clothes treating apparatus 100 based on the collected information (S303).

In detail, the controller 180 may generate information related to a use time zone and a non-use time zone of the clothes treating apparatus 100, based on the collected information. The controller 180 may set a time zone, in which the user is expected to put new clothes into the clothes treating apparatus 100 or take previously-stored clothes out, as the use time zone, and a time zone, in which the user is moved far away from the clothes treating apparatus 100 or is expected not to apply any input to the clothes treating apparatus 100, as the non-use time zone.

For example, the controller 180 may set a duration from a first time point at which clothes are added to the clothes treating apparatus 100 to a second time point at which clothes stored in the clothes treating apparatus 100 are taken out, as the non-use time zone. In another example, the controller 180 may set a duration from a third time point after a predetermined time elapses from the first time point to a fourth time point that is earlier than the second time point, as the non-use time zone.

The controller 180 may also adjust a difference between the first and third time points or a difference between the second and fourth time points based on the usage history of the clothes treating apparatus 100. That is, the controller 180 may calculate a standard deviation of data associated with a time point at which clothes are introduced into the clothes treating apparatus 100 or a standard deviation of data associated with a taken-out time point. The controller may adjust the difference between the first and third time points or the difference between the second and fourth time points based on the calculated standard deviation.

In one embodiment, the controller 180 may divide 24 hours into a plurality of time zones, calculate probability that the user is to use the clothes treating apparatus 100 for each divided time zone, and set a time zone with a first probability value or more, among those calculated probabilities, as the use time zone. Similarly, the controller 180 may set a time zone with a second probability value or less, among those calculated probabilities, as the non-use time zone.

In another embodiment, the communication unit 110 may receive information related to electric charges, and the controller 180 may extract the use time zone of the clothes treating apparatus 100 based on the information related to the usage history and the information related to the electric charges. The controller 180 may determine that the user is less likely to use the clothes treating apparatus 100 as the electric charge is lower.

In another embodiment, the communication unit 110 may receive information related to a use time zone of another clothes treating apparatus from an external server. The controller 180 may extract the use time zone of the clothes treating apparatus 100 by using the information related to the use time zone of the another clothes treating apparatus 100 together with the information related to the usage history of the clothes treating apparatus 100. That is, the controller 180 may extract the use time zone of the clothes treating apparatus 100 based on a usage pattern of a user of the another clothes treating apparatus.

The controller 180 may control the air supply device 30 to initiate a storage function of the clothes treating apparatus 100 (S304).

For example, the controller 180 may control the air supply device 30 to repeatedly perform a stroke of supplying dry air for 15 minutes and then waiting for 45 minutes.

Such a stroke may be defined as the storage function of the clothes treating apparatus 100, and the storage function may be released or started by a user input. Also, the controller 180 may adjust the supply time of the dry air and the waiting time based on a user input.

That is, when the storage function is started, the controller 180 may control the air supply device 30 to perform a heating stroke for a first time interval (S305). Further, the controller 180 may control the clothes treating apparatus 100 to wait for a second time interval after the heating stroke is performed for the first time interval.

In addition, the controller 180 may determine whether the storage function has been terminated at each predetermined time interval (S307).

If the storage function is in progress, the controller 180 may determine whether a current time point is included in the use time zone based on the analyzed usage pattern (S308).

That is, the controller 180 may determine whether the current time point is included in the use time zone or in the non-use time zone.

When it is determined that the current time point is included in the use time zone, the controller 180 may sequentially perform the heating stroke (S305) and the waiting step (S306). That is, the controller 180 may drive the air supply device in a preset pattern within the use time zone.

When it is determined that the current time point is not included in the use time zone, the controller 180 may control the clothes treating apparatus 100 to wait for a third time interval (S309).

That is, when it is determined that the current time point is not included in the use time zone, the controller 180 may stop the operation of the clothes treating apparatus.

For example, the third time interval may correspond to a time interval of a preset non-use time zone. In another example, the third time interval may be set to be longer than the first and second time intervals.

When it is determined that the current time point is not included in the use time zone, the controller 180 may control the communication unit 110 to transmit a message related to a change in an operation state of the clothes treating apparatus to an external terminal.

Meanwhile, the communication unit 110 of the clothes treating apparatus 100 may perform wired/wireless communication with the external terminal. When a current time point does not correspond to the use time zone and the non-use time zone, the controller 180 may control the communication unit 110 to transmit a message to the external terminal to request for a command related to the operation of the clothes treating apparatus 100.

Also, when the current time point does not correspond to the use time zone and the non-use time zone, the controller 180 may reduce an operation cycle (period) of the air supply device through comparison with the preset pattern.

The controller 180 may also restart the operation of the clothes treating apparatus 100 when a current time point is included within a predetermined time interval from a start time point of the use time zone. For example, the controller 180 may drive the air supply device 30 of the clothes treating apparatus 100 for a predetermined time when the current time point is 20 minutes before the start of the use time zone.

Hereinafter, an example of a user interface displayed on a display of a clothes treating apparatus of the present invention will be described with reference to FIG. 5.

Figure 5:
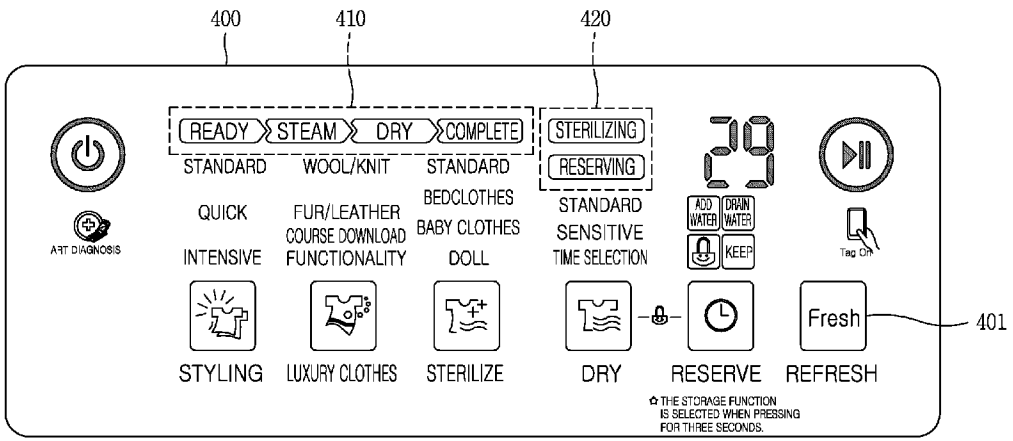
FIG. 5 is a conceptual view illustrating one embodiment related to a display of a clothes treating apparatus while a method for controlling a clothes treating apparatus according to the present invention is executed.

As illustrated in FIG. 5, even when there is no user input after new clothes are introduced into the clothes treating apparatus 100, a display 400 of the clothes treating apparatus 100 outputs thereon a button for activating one mode of the clothes treating apparatus 100 in which a preset operation is performed with respect to the newly-introduced clothes.

The controller 180 may activate or deactivate the one mode of the clothes treating apparatus 100 whenever a user input is applied to the button 401.

The display 400 of the clothes treating apparatus 100 may output a first status display window 410 and a second status display window 420. The activation or deactivation of the one mode may be output on at least one of the first and second status display windows.

The controller 180 may stop the operation of the clothes treating apparatus 100 and output a status icon 402 to the second status display window when a current time point enters the non-use time zone. That is, when a power saving mode for switching the clothes treating apparatus 100 into a waiting status is started at the non-use time zone, the controller 180 may output the status icon 402 on the second status display window to inform the user that the power saving mode is in the activated state.

According to the present invention, unnecessary power consumption can be reduced while maintaining a storage performance of clothes currently stored in a clothes treating apparatus, thereby increasing power efficiency.

Further, according to the present invention, since the clothes treating apparatus can operate only in a required section according to a user's usage pattern, even without a separate input applied after clothes are put in the clothes treating apparatus, thereby enhancing user convenience.

Further, according to the present invention, since a driving time of a heat pump of the clothes treating apparatus is reduced, a lifespan of the clothes treating apparatus can be increased and noise generated by the clothes treating apparatus can be reduced.

It should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A clothes treating apparatus, comprising:

a communication unit to transmit or receive information about the clothes treating apparatus;

a memory to store the information;

an air supply device to heat and supply air into an accommodation space of the clothes treating apparatus;

a hanger provided within the accommodation space, the hanger configured to have clothes caught thereon;

a sensing unit to sense information related to the clothes caught on the hanger; and a controller to:

extract a use time zone and a non-use time zone of the clothes treating apparatus based on the information, drive the air supply device in a preset pattern within the use time zone, and stop an operation of the clothes treating apparatus within the non-use time zone, wherein the controller detects at least one of:

a time point at which clothes are introduced into the accommodation space, a time point at which clothes are taken out of the accommodation space, and a time point at which a door installed on the clothes treating apparatus is opened and closed, based on information sensed by the sensing unit, wherein the information is related to usage history of the clothes treating apparatus, and wherein the hanger includes a motor configured to provide a predetermined motion to the clothes caught on the hanger.

2. The apparatus of claim 1, wherein the controller divides time into a use time zone in which probability that a user is to use the clothes treating apparatus is a first value or more, and a non-use time zone in which the probability is a second value or less, and wherein the first value is greater than the second value.

3. The apparatus of claim 2, wherein the communication unit performs wired/wireless communication with an external terminal, and wherein the controller controls the communication unit to transmit a message to the external terminal to request for a command related to the operation of the clothes treating apparatus, when a time point does not correspond to the use time zone and the non-use time zone.

4. The apparatus of claim 2, wherein the controller reduces an operation cycle of the air supply device through comparison with the preset pattern, when a time point does not correspond to the use time zone and the non-use time zone.

5. The apparatus of claim 1, wherein the information is related to usage history of the clothes treating apparatus.

6. The apparatus of claim 5, wherein the communication unit receives information related to electric charges, and wherein the controller extracts the use time zone of the clothes treating apparatus based on the information related usage history and the information related to the electric charges.

7. The apparatus of claim 5, wherein the information related to the usage history includes information related to at least one of:

a time point at which clothes are introduced into the accommodation space, a time point at which clothes are taken out of the accommodation space, a time point at which a door installed on the clothes treating apparatus is opened and closed, and a time point at which a user input related to an operation of the clothes treating apparatus is applied.

8. The apparatus of claim 1, wherein the controller updates the information related to the usage history, on the basis of at least one of:

a time point at which clothes are introduced into the accommodation space, a time point at which clothes are taken out of the accommodation space, and a time point at which a door installed on the clothes treating apparatus is opened and closed.

9. The apparatus of claim 1, wherein the hanger includes a motor to apply motion to the clothes caught on the hanger, and wherein the controller:

drives the motor at a preset time interval when the door is opened and then closed, detects information related to a weight of the clothes caught on the hanger, based on a power value consumed by the motor, while the motor is driven, and detects the time point at which the clothes are introduced into the accommodation space, based on the detected weight.

10. The apparatus of claim 1, wherein the sensing unit includes a weight sensor to detect a weight of the clothes caught on the hanger, and wherein the controller detects the time point at which the clothes are introduced into the accommodation space, based on a sensing value of the weight sensor.

11. The apparatus of claim 5, wherein the communication unit receives information related to a use time zone of another clothes treating apparatus from an external server, and wherein the controller extracts the use time zone of the clothes treating apparatus, by using the information related to the usage history and the information related to the another clothes treating apparatus.

* * * * *